United States Patent [19]

Roberts

[11] 4,417,666

[45] Nov. 29, 1983

[54] CONTAINER AND CLOSURE HAVING TAMPER-PROOF FEATURE

[75] Inventor: Derek C. Roberts, London, England

[73] Assignee: Johnsen & Jorgensen (Plastics) Limited, London, England

[21] Appl. No.: 350,581

[22] Filed: Feb. 22, 1982

[51] Int. Cl.[3] ..... B65D 41/34

[52] U.S. Cl. ..... 215/256; 215/258

[58] Field of Search ..... 215/256, 258, 329; 220/270

[56] References Cited

U.S. PATENT DOCUMENTS

| | | | |
|---|---|---|---|
| 3,893,583 | 7/1975 | McLaren | 215/256 |
| 4,342,400 | 8/1982 | Llera | 215/256 |
| 4,343,408 | 8/1982 | Csaszar | 215/258 |

*Primary Examiner*—George T. Hall

*Attorney, Agent, or Firm*—Woodard, Weikart, Emhardt & Naughton

[57] ABSTRACT

A container closure which has a cap part with an internal screw thread to engage with an external screw thread on the container, a tear away band connected to the skirt of the cap part to show whether the closure has been tampered with and a captive band connected to the tear away band.

5 Claims, 7 Drawing Figures

CONTAINER AND CLOSURE HAVING TAMPER-PROOF FEATURE

This invention relates to closures for containers and to container and closure assemblies.

According to a feature of the invention we provide a container closure comprising a cap part with an internal screw thread for engagement with an external screw thread on a container, a tear away tamper evident band connected to the cap part and a captive band connected to the tear away band, means being provided on the tear away band for engagement with the container and means being provided on the captive band to ensure that the captive band seats firmly on the container when the tear away band has been removed. The captive band assists the tear away band in preventing unauthorised removal of the closure from the container and when the tear away band has been removed the captive band remains in position on the container and improves the aesthetic appearance of the assembly. Preferably a discontinuous thread is provided on the closure and on the container similar to that described in our British Pat. Nos. 1,430,302 and 1,483,403 in which there is described a container and closure assembly in which the closure comprises a retaining band combined with a screw cap characterised by the provision of a discontinuous screw thread on the cap with inclined lower surfaces when viewed in axial section for engagement with a discontinuous screw thread, around the mouth of the container, with inclined upper surfaces when viewed in axial section the contour of the screw-threads being such that if an attempt to be made to unscrew the closure without first tearing away the retaining band, the inclined surfaces of the screw threads abut against one another, the resistance of the retaining band being sufficient to cause the inclined surfaces on the cap to slip off the inclined surfaces on the container so that the closure goes round and round but does not come off the container.

Figure 1:
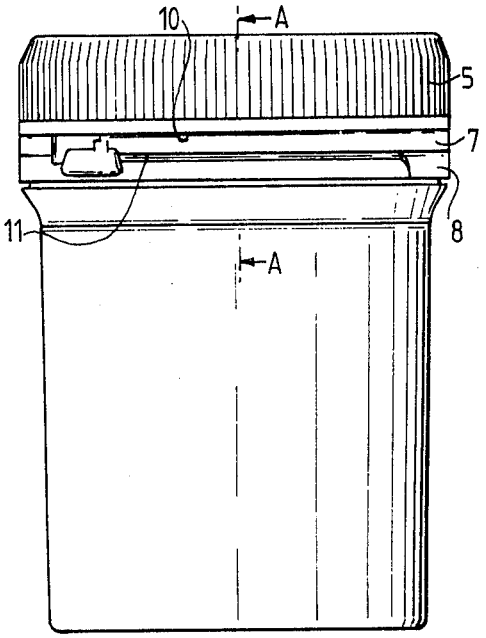
Figure 2:
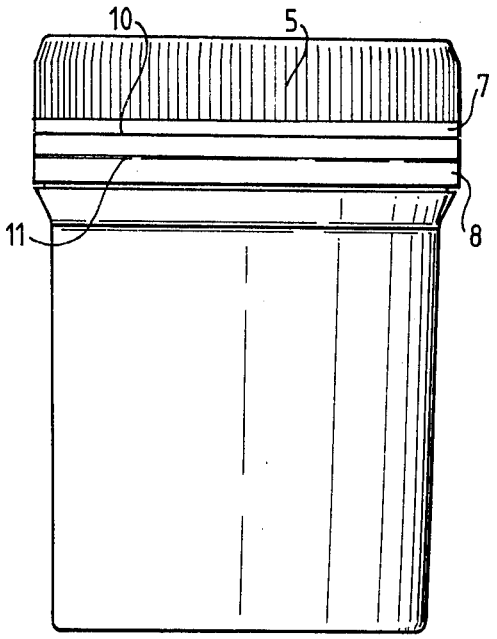

In order that the invention may be more clearly understood reference is now directed to the accompanying drawings given by way of example in which:

FIGS. 1 and 2 are elevation views of the container and closure assembly.

Figure 3:
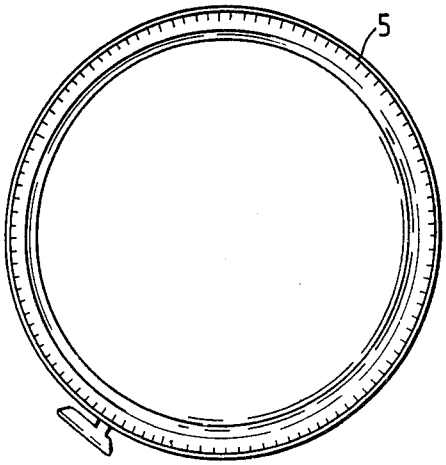
Figure 4:
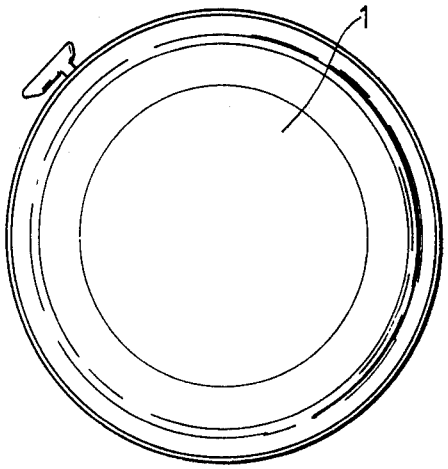
Figure 5:
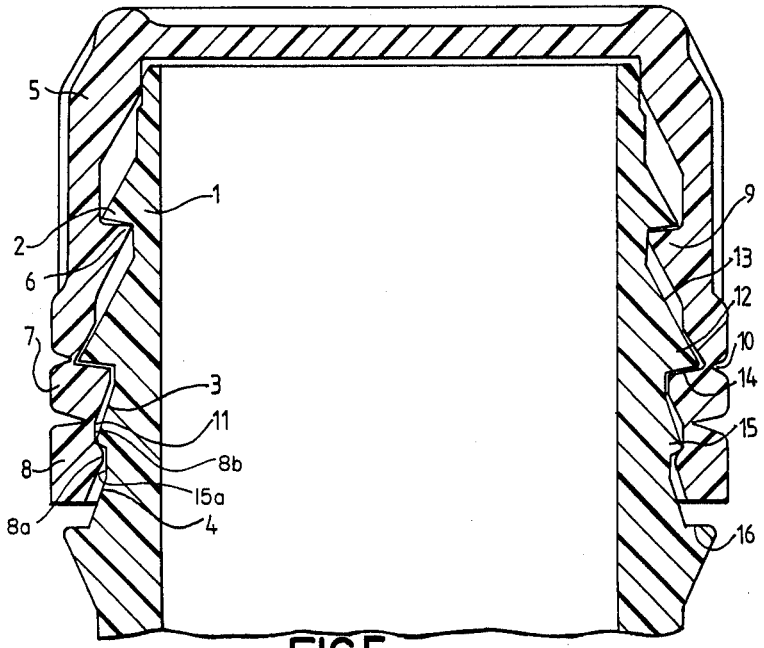
Figure 6:
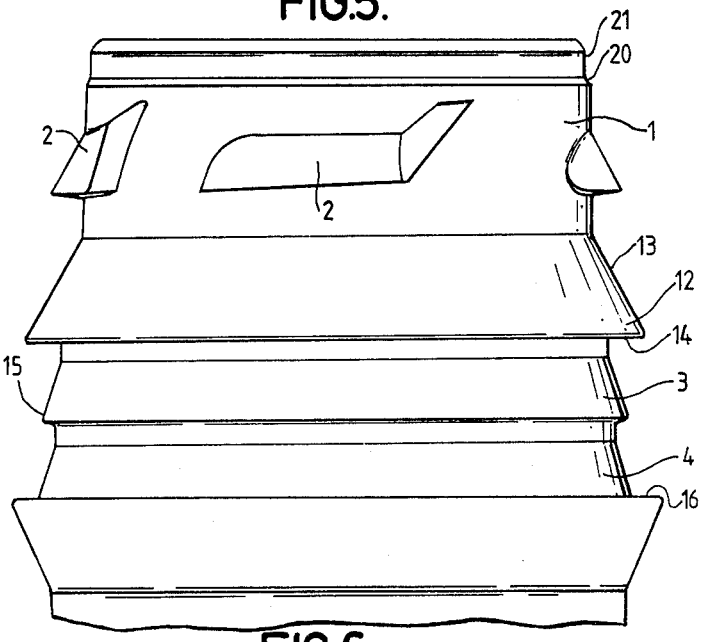

FIGS. 3 and 4 are top and bottom plan views. FIG. 5 is an enlarged section of A—A FIG. 1. FIG. 6 is an enlarged fragmentary view of the container with the closure removed.

Figure 7:
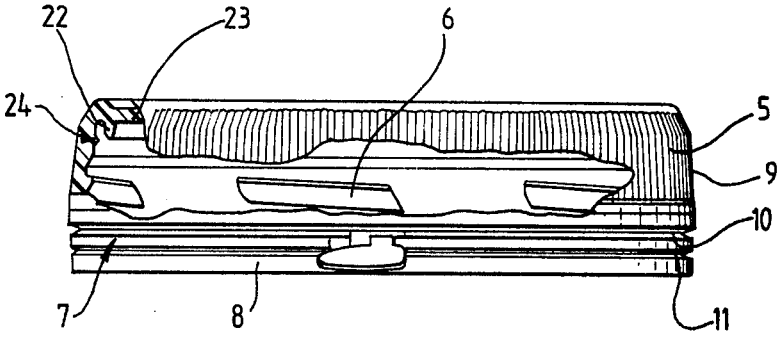

FIG. 7 is a partly sectional view of a modified form of closure according to the invention.

Referring to the drawings a container 1 has a multi-start discontinuous external screw thread indicated generally at 2, a tear-away band-seating 3 and a captive band-seating 4. A closure 5 has an internal multi-start (in this example four start) discontinuous screw thread 6, a tear away band 7 and a captive band 8. Weakened lines 10 and 11 in the skirt 9 of the closure facilitate tearing away of the band 7. The container 1 is shaped to provide an external annular bead 12 that is nose shaped in section with an inclined upper surface 13 and a substantially horizontal lower surface 14. The closure 5 is shaped so that it can easily be pushed downwardly over the bead 12 but when in position on the container 1 as shown e.g. in FIG. 5, it is almost impossible to remove the closure simply by an upward movement. The downward movement of the closure 5 relatively to the container 1 is preferably effected by pushing straight down into position but alternatively the closure 5 can be applied by a screwing down movement.

The line 10 of weakness substantially coincides with the outer end of the bead 12 so that when the band 7 is torn away the top or cap part of the closure can easily be removed by unscrewing a part turn and can be replaced as required. The band 7 sits comfortably on the seating 3 as shown and the container is shaped to provide a lower bead 15 and annular recess **15*a* with which the captive band 8 engages. This engagement by captive band 18 is by means of inwardly protruding annular bead 8*a* and annular recessed portion 8*b* which is disposed directly above the bead. The engagement of the band 8 with the bead 15 provides an extra tamper proof feature because this engagement makes it even more difficult to remove the closure without first tearing away the band 7. When the closure 5 is in operative position on the container 1 as shown for example in FIG. 5 the captive band 8 will be substantially in the position shown in FIG. 5 and will be effective in its tamper proof function. When the band 7 is torn away by tearing along the lines 10 and 11 the band 7 will fall away and the captive band 8 will be left in position. The band 8 will then adjust itself to the outer contour of the seating 4 and will probably move downwardly to rest on a ledge 16 on the container 1. When in this position the captive band 8 serves no function other than to partially fill the gap between the bead 12 and the ledge 16 in order to improve the aesthetic appearance of the assembly after initial opening. The screw thread illustrated in the drawings is the same as the thread described in our British Pat. Nos. 1,430,302 and 1,483,403. When the closure is complete and is seated in operative position on the container there is a very considerable constraint imposed upon the closure preventing upward movement due to the presence of both the bands 7 and 8 which engage with the container. Any attempt to unscrew the closure with the band 7 in position simply causes the discontinuous threads on the closure 5 to repeatedly jump off the discontinuous threads on the container due to the positive downward pull of the bands 7 and 8. To unscrew the upper part of the closure successfully it is first necessary to remove the band 7 whereupon the restraint is also removed. However removal of the band 7 is very obvious and if the band 7** be removed by an unauthorised person it is at once clear that the assembly has been tampered with.

The body part of the container may be of any desired and convenient shape and the parts of the assembly are preferably moulded from plastics material. The invention includes the improved closure with a complete circular captive band and also an assembly of the closure and a container.

An important feature of the invention is the provision of a suitable sealing means to protect the contents of the container from contamination. Sealing may be effected by engagement of the outer top surface of the container with the inner top surface of the closure. Reference e.g. to FIG. 6 will show that the container 1 may be shaped at 20 to produce a top annular outer portion 21 with a smooth unbroken surface which can be of reduced diameter but the shaping at 20 is purely optional and the portion of reduced diameter need not be provided. The portion 21 engages with an inner annular portion 22 of the closure see e.g. FIG. 5. The top edge of the container may also be arranged to engage with a resilient washer or similar pad disposed within the closure.

In the embodiment described by way of example in FIGS. 1 to 6 the screw thread has four starts but it will be understood that a thread having more or less starts may be used depending upon the circumstances.

Referring now to FIG. 7 it will be noted that the multi-start thread 6 in this example has six starts for co-operation with a container (not shown) also having six starts. In FIG. 7 the same references are used for the same parts as in FIGS. 1 to 6; it will be noted however that in FIG. 7 an annular sealing bead 22 is provided on the underside 23 of the top of the closure 5. This bead 22 is of importance because in operation when the closure 5 is in position on the container 1 the bead 22 forms a plug which enters the mouth or top bore of the container. In addition an annular sealing bead 24 is provided to seal against the outer surface of the container. In the FIG. 7 embodiment therefore we have made provision for a sealing plug within the top bore of the container and a sealing bead outside the top rim of the container due to the manner in which we have developed the mould design. This was difficult to achieve in an economic manner with our earlier design shown in FIG. 5 and is a feature not previously employed in our Patents 1,430,302 and 1,483,403.

I claim:

1. A container and closure assembly wherein the closure comprises a cap part with an internal discontinuous multi-start screw thread, a tear-away tamper-evident band connected to the cap part by a first line of weakness, a captive band connected to the tamper-evident band by a second line of weakness and internal annular projecting bead means on the captive band and wherein the container has a neck defining an open mouth, a discontinuous multi-start external screw thread around the mouth, an external annular nose-shaped bead below the screw thread and with an inclined upper surface and a substantially horizontal lower surface, an annular recess around the neck of the container for engagement by said projecting bead means on the captive band and annular ledge means disposed around the neck of the container below said annular recess suitably adapted and disposed to receive said captive band after said tamper-evident band has been torn away from said assembly.

2. The container and closure assembly of claim 1 wherein the closure is suitably designed and arranged so that it can be pushed straight downwardly on said container into an operative position.

3. The container and closure assembly of claim 2 wherein said closure further includes an annular sealing bead on the undersurface of the top of the closure to form a sealing plug with the mouth of the container when said closure is in said operative position.

4. The container and closure assembly of claim 1 wherein said closure further includes an annular sealing bean on the undersurface of the top of the closure to form a sealing plug with the mouth of the container when said closure is in an operative position on said container.

5. The container and closure assembly of claim 1 wherein said closure is provided with a line of weakness between the cap part and the tear-away band, said line of weakness being so positioned so as to coincide substantially with the outer end of the nose-shaped bead on the container when said closure is in an operative position on said container.

* * * * *